US006042450A

United States Patent [19]

Leversedge et al.

[11] Patent Number: 6,042,450

[45] Date of Patent: Mar. 28, 2000

[54] DOLL WITH SIMULATED PHYSIOLOGICAL FUNCTIONS

[75] Inventors: John Malcolm Leversedge, Auckland, New Zealand; Victor Manuel Pracas, Waroona, Australia

[73] Assignee: Toy Concepts Pty. Ltd., Australia

[21] Appl. No.: 08/624,595

[22] PCT Filed: Oct. 18, 1994

[86] PCT No.: PCT/AU94/00636

§ 371 Date: May 19, 1997

§ 102(e) Date: May 19, 1997

[87] PCT Pub. No.: WO95/11068

PCT Pub. Date: Apr. 27, 1995

[30] Foreign Application Priority Data

Oct. 18, 1993 [AU] Australia ..... PM1856

[51] Int. Cl.[7] ..... A63H 3/24; A63H 3/40; A63H 13/00; A63H 3/46

[52] U.S. Cl. ..... 446/304; 446/305; 446/341; 446/348; 446/351; 446/376

[58] Field of Search ..... 446/376, 384, 446/391, 395, 304, 305, 337, 339, 349, 341, 343, 345, 348, 351, 198, 183

[56] References Cited

U.S. PATENT DOCUMENTS

| | | | |
|---|---|---|---|
| 440,706 | 11/1890 | Graeser | 446/395 X |
| 837,216 | 11/1906 | Gilbert | 446/341 |
| 2,144,436 | 1/1939 | Wittmann | 446/345 X |
| 2,641,866 | 6/1953 | Schiller | 446/351 X |
| 3,775,901 | 12/1973 | Ellman et al. | 446/305 X |
| 3,792,550 | 2/1974 | Crawford | 446/198 X |
| 4,413,441 | 11/1983 | Hunter et al. | 446/305 |
| 4,443,200 | 4/1984 | Murphy | 446/305 X |
| 5,083,962 | 1/1992 | Pracas | 446/184 |

FOREIGN PATENT DOCUMENTS

| | | | |
|---|---|---|---|
| 556163 | 9/1943 | United Kingdom | 446/395 |

*Primary Examiner*—D Neal Muir
*Attorney, Agent, or Firm*—Michael Best & Friedrich LLP

[57] ABSTRACT

A doll with simulated physiological functions, in particular a toy doll in the form of a teddy bear, is described. The teddy bear has a head with eyes that can move and a mouth that opens and closes. A lower jaw pivots about a first axis to provide the opening and closing action of the mouth. A mechanical linkage means is provided to transmit a movement of the lower jaw to another part of the doll, for example to the eyes, whereby opening and/or closing of the mouth, for example when feeding the teddy bear, can produce a simulated physiological response from the doll, for example a responsive eye movement. The mechanical linkage means also actuates a sound generating means. The arrangement of the mechanical linkage means is such that there is a degree of unpredictability in the simulated physiological functions which enhances the long term play value of the doll and increases the enjoyment of a child. Incorporating other simulated physiological functions further enhances the play value of the teddy bear.

11 Claims, 10 Drawing Sheets

DOLL WITH SIMULATED PHYSIOLOGICAL FUNCTIONS

FIELD OF THE INVENTION

The present invention relates to a doll with simulated physiological functions and relates particularly, though not exclusively, to such a doll in the form of a toy doll, for example, a teddy bear.

BACKGROUND TO THE INVENTION

From time immemorial toy dolls have been a source of joy and comfort to children who use them to role play child-adult relationships and to explore parental role models. The doll will often acquire a personality in the child's mind and will be used to play-act various behaviour patterns with which the child is familiar or which the child is itself learning to accommodate. Doll manufacturers are well aware of the importance of simulation and try to assist the child's imagination by producing dolls which are as life-like as possible. Thus many dolls are now produced with eyes that close when the doll is placed in a recumbent position to simulate sleep. More recently, doll manufacturers have produced dolls which simulate ingestion of food and drink, examples of which are described in U.S. Pat. Nos. 3,855,729; 3,858,352; 4,504,241; and, 5,083,962.

When assessing the commercial potential of a toy one of the factors taken into consideration is the so-called "play value" of the toy. The play value is to some extent a measure of the capacity of the toy to hold a child's attention and to evoke interest and involvement. The play value of a toy doll may be enhanced by increasing the number of moving parts, improving the doll's life-like appearance and/or by incorporating various simulated physiological functions as noted above. One of the difficulties faced by doll manufacturers is that such simulated physiological functions are by nature very mechanical and therefore predictable—if the child presses this button or operates that lever then the doll will do the same thing every time. This predicability can in fact reduce the long term play of the doll as it leaves little room for imagination and the child quickly becomes bored.

SUMMARY OF THE INVENTION

The present invention was developed with a view to providing a doll with a simulated physiological functions which, when embodied in the form of a toy doll improves the play value of the doll. Although the following description will be given primarily with reference to a toy doll, it will be understood that the doll may also be embodied in the form of an educational aid that can be used to demonstrate various physiological functions.

According to one aspect of the present invention there is provided a doll with simulated physiological functions, including a head with eyes that can move, the doll further comprising:

a mouth that opens and closes, the head having a lower jaw that pivots about a first axis to provide the opening and closing action of the mouth; and, mechanical linkage means having a first portion pivotally connected to said lower jaw and adapted to pivot about a second axis which is spaced from said first axis, said mechanical linkage means being adapted to transmit a movement of the lower jaw to another part of the doll whereby, in use, opening and/or closing of the mouth, for example to feed the doll, can produce a simulated physiological response from the doll.

Typically the doll's eyes are designed to pivot from an opened towards a closed position and vice versa. Each eye may be weighted so as to pivot towards the closed position when the orientation of the doll's head is changed from an upright towards a recumbent position. Advantageously each eye is provided with a secondary tilt mechanism to cause the eye to pivot to a fully closed position when the doll is lying down. In a preferred embodiment said secondary tilt mechanism comprises a projection provided at the back of each eye, and a moveable weight with a guide on which the moveable weight can move, said guide being mounted relative to the eye such that when the doll is lying down it is tilted at a sufficient angle to enable the moveable weight to move down the guide under the force of gravity whereby, in use, the moveable weight can engage said projection to cause the eye to pivot to the fully closed position. Preferably said moveable weight is ball-shaped and said guide is a hollow tube.

Preferably said mechanical linkage means does not permanently couple the lower jaw to the eyes, but transitorily couples the lower jaw to the eyes so as to be capable of producing transitory eye movement responsive to movement of the lower jaw. In one embodiment said first portion of the mechanical linkage means comprises a substantially rigid actuating member having engaging means provided at a free end thereof remote from the pivotal connection to the lower jaw, and said mechanical linkage means further comprises a pair of pivotal levers, each lever being adapted to engage said projection on a respective eye during pivotal movement from a first position to a second position, and wherein said engaging means of the actuating member engages said pivotal levers to effect said pivotal movement when the lower jaw is moved to open or close the mouth. Preferably said engaging means engages said pivotal levers to effect said pivotal movement during an upward stroke of the actuating member which occurs when the lower jaw is moved to open the mouth. Advantageously both pivotal levers are biased to produce a return movement to said first position when said engaging means disengages the pivotal levers, each pivotal lever being adapted to momentarily engage said projection on a respective eye during said return movement. Preferably said engaging means is adapted to not engage the pivotal levers during a downwards stroke when the pivotal levers have returned to the first position.

With this arrangement eye movement may be rapid or slow depending on the extent to which the lower jaw is moved to open and close the mouth, creating the illusion of varying degrees of responsiveness of the doll, for example, during feeding. This enhances the enjoyment of the child playing with the doll as the doll's behaviour is not always easily predictable.

In a preferred embodiment of the doll said actuating member also actuates a sound generating means whereby, in use, the sound generated is to some degree dependent on the extent of movement of the lower jaw, further enhancing the play value of the doll. Advantageously said sound generating means comprises a mechanically operated bellows and an air-driven vibratory reed.

Preferably the doll further comprises:

a head with a mouth through which liquid and solid substances can be inserted;

a torso having first and second chambers provided therein and adapted to contain said liquid and solid substances respectively; and, a separating means provided in a throat region of the doll for substantially separating said liquid and solid substances whereby, in use, liquid and solid substances inserted through the mouth are substantially separated before passing into said first and second chambers respectively.

In a preferred embodiment said separating means comprises a sieve member extending over substantially the whole of said throat region with the exception of an aperture, said sieve member being adapted to pass said liquid substance therethrough but to prevent said solid substances from passing therethrough other than through said aperture. In this embodiment said aperture is connected to said second chamber whereby, in use, said solid substances can pass through said aperture directly into the second chamber. Preferably said second chamber is provided with an outlet valve proximate a lower region of the torso and which is biased towards a normally closed position. Advantageously the outlet valve can be opened by squeezing the torso adjacent said lower region. In a preferred embodiment said outlet valve is in the form of a slide valve having a slidable closure member which protrudes at the front of the torso when the outlet valve is in the closed position. The slidable closure member may have a first aperture provided therein which can be brought into alignment with a second aperture provided in a base of the second chamber by pushing the slidable closure member inwards whereby, in use, the contents of the second chamber can be evacuated.

Preferably the doll is provided with a chamber pot or "potty" on which the doll can be seated for toileting, the potty having a protruding portion which passes between the doll's legs when seated on the potty and which is adapted to press on the doll's torso adjacent said lower region whereby, in use, said outlet valve can be actuated to evacuate the contents of the second chamber into the potty.

BRIEF DESCRIPTION OF THE DRAWINGS

In order to facilitate a better understanding of the nature of the invention, a preferred embodiment of the doll will now be described in detail, by way of example only, with reference to the accompanying drawings in which.

DETAILED DESCRIPTION OF PREFERRED EMBODIMENT

Figure 4:
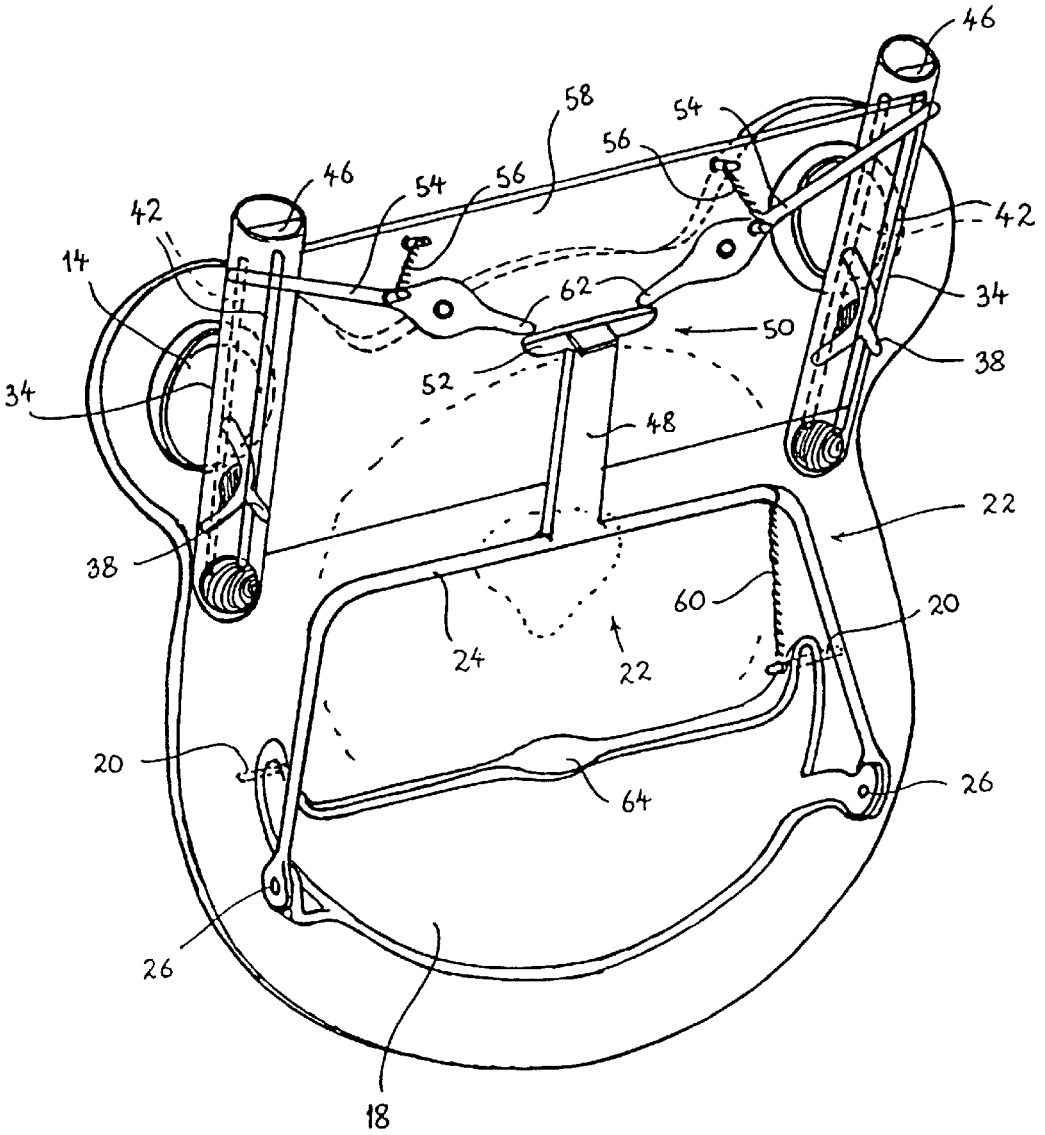
FIG. 4 is a rear perspective view illustrating a mechanism used to transmit movement to the eyes of the teddy bear of FIG. 1.

The illustrated embodiment of a doll according to the present invention is in the form of a toy teddy bear 10. The teddy bear 10 has a head 12 with eyes 14 that can move and a mouth 16 that opens and closes. As can be seen most clearly in FIGS. 4 and 6 the head 12 of the teddy bear has a lower jaw 18 that pivots on a pair of pivotable connections about a first axis 20 to provide the opening and closing action of the mouth 16. A mechanical linkage means 22 is provided, having a first portion 24 pivotally connected to the lower jaw 18 and adapted to pivot about a second axis 26 which is spaced from the first axis 20, as can be seen most clearly in FIGS. 4 and 6. Mechanical linkage means 22 is adapted to transmit a movement of the lower jaw 18 to an upper part of the head 12 whereby, in use, opening and/or closing of the mouth 16, for example when feeding the teddy bear 10, can produce a simulated physiological response from the doll. For example, mechanical linkage means 22 transmits a movement of the lower jaw 18 to the eyes 14 so that opening and/or closing of the mouth 16 produces a responsive eye movement.

In a conventional doll with moveable eyes each eye is typically designed to pivot from an open to a closed position and vice versa. Each eye is weighted so as to pivot towards the closed position when the orientation of the doll's head is changed from an upright position towards a recumbent position. This arrangement works quite well where the doll's eye is intended to simulate a human eye, since the doll's eye need only pivot through approximately 45° in order to fully conceal the iris below the lower eye lid of the doll. However, where the doll's eye is intended to simulate an animal's eye, such as in the teddy bear of the illustrated embodiment, the eye must be capable of pivoting through almost 180° in order to fully conceal the iris below the lower eye lid of the doll. Therefore, each eye of the teddy bear 10 is provided with a secondary tilt mechanism 28 designed to cause the eye to pivot to a fully closed position when the teddy bear is in a recumbent position.

Figure 2:
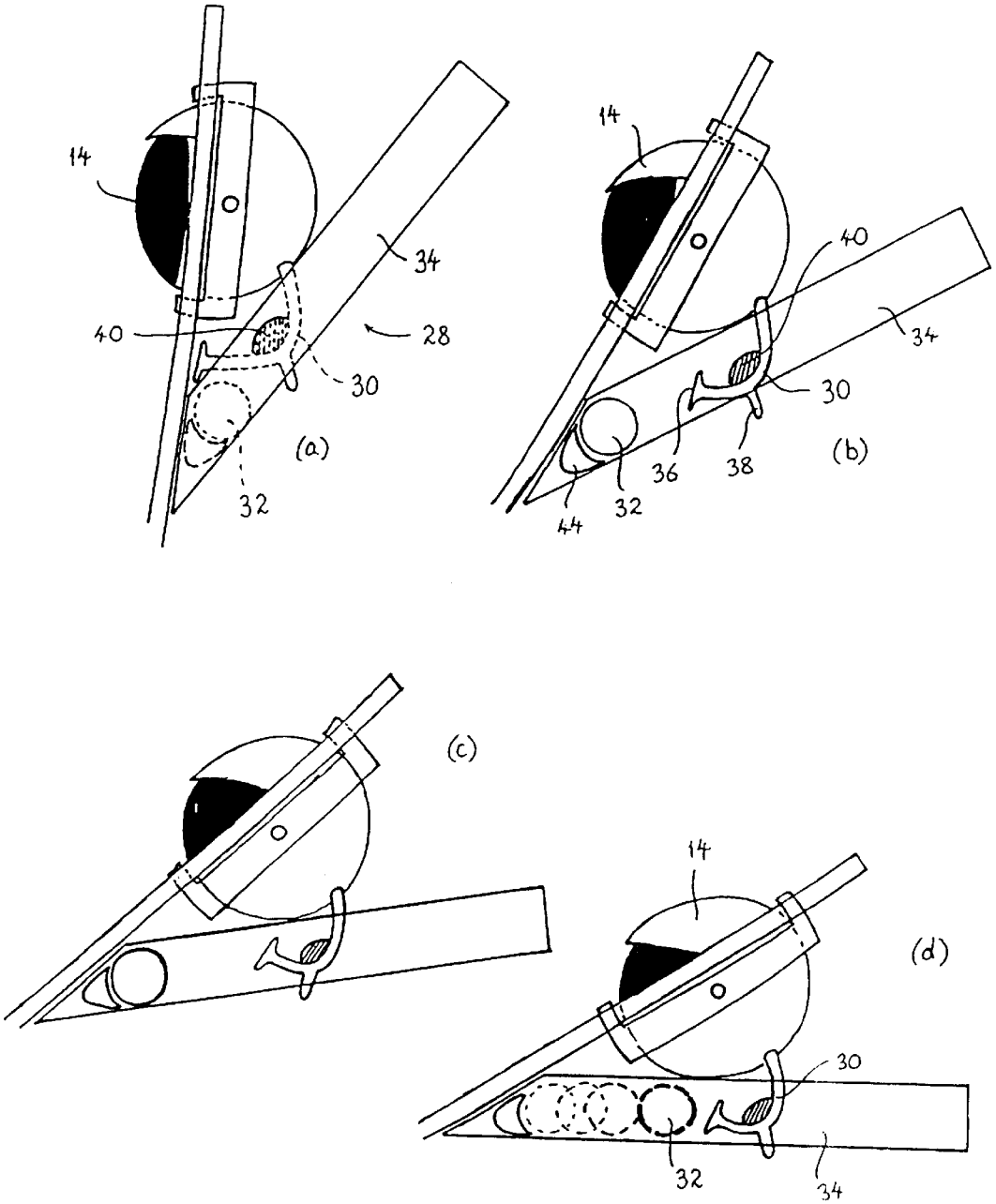
FIGS. 2(*a*), (*b*), (*c*) and (*d*) illustrate an eye employed in the teddy bear of FIG. 1 at various positions of opening and closure.
Figure 3:
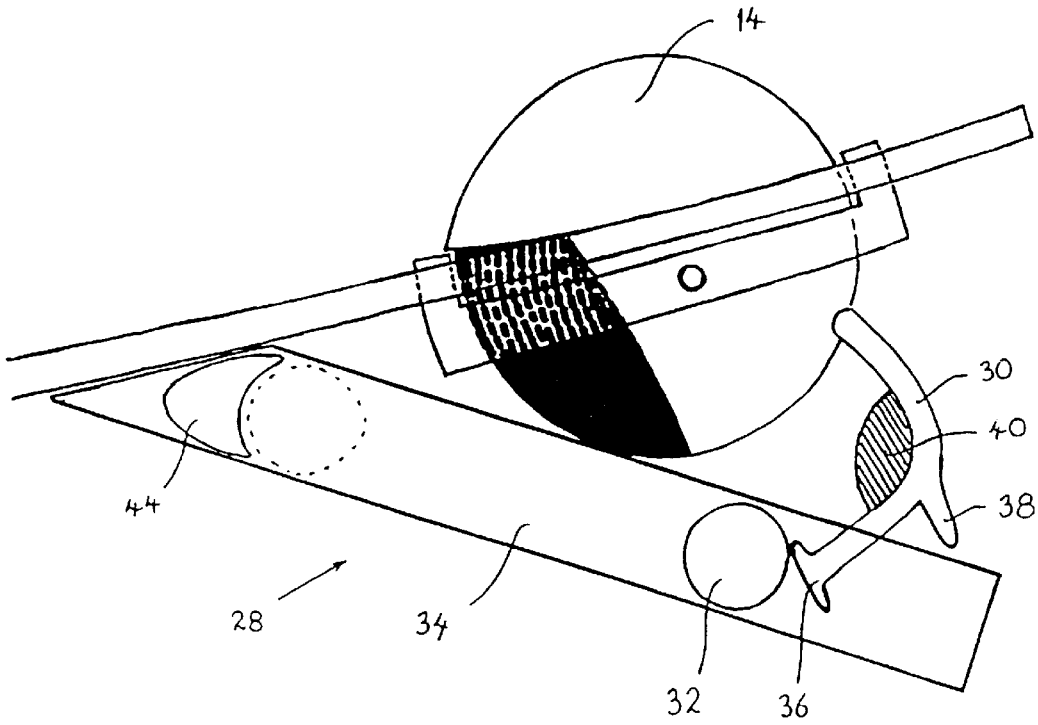
FIG. 3 illustrates the eye of FIG. 2 in a fully closed position.

As illustrated most clearly in FIGS. 2 and 3 of the accompanying drawings, the secondary tilt mechanism 28 comprises a projection 30 fixed to the back of each eye 14, and a moveable weight 32 with a guide 34 on which the moveable weight can move. In this embodiment, the moveable weight 32 is of spherical shape and may be, for example, a steel ball bearing or glass marble, and the guide 34 is a small hollow tube in which the moveable weight 32 can roll. Projection 30 is in the form of a small leg having a toe 36 and a heel 38. A small lead weight 40 is attached to the projection 30 and provides the initial tilting movement of the eye 14 relative to the head of the teddy bear as it is moved to a recumbent position.

Hollow tube 34 is provided with diametrically opposed slots 42 (see FIG. 4) through which the projection 30 on eye 14 projects and is free to pivot. Hollow tube 34 is mounted at an angle relative to eye 14 such that when the teddy bear is moved to a recumbent position the tube 34 is tilted at a sufficient angle to enable the weighted ball 32 to roll down the tube under the force of gravity as illustrated in FIG. 2(*d*). As the weighted ball 32 rolls down the tube 34 it will eventually engage the toe 36 of projecting leg 30 forcing the eye 14 to pivot to the fully closed position as illustrated in FIG. 3. When the teddy bear is returned to the upright position ball weight 32 will roll back down the tube 34 to its rest position and eye 14 will be free to pivot back to its open position due to the force of gravity on lead weight 40. Hollow tube 34 is provided with a rubber stop 44 at one end to absorb the sound of the weighted ball 32 when it returns to its rest position. Likewise, the other end of the hollow tube 34 is fitted with a semi-circular stop 46 (see FIG. 4) designed to prevent the weighted ball 32 from escaping from the tube 34. The semicircular stop 46 may also be provided with a rubber pad or other resilient material on its inner surface to absorb the sound of the weighted ball 32 as it strikes the end of the tube 34.

In this embodiment, the mechanical linkage means 22 does not permanently couple the lower jaw 18 to the eyes 14, but instead is designed to transitorily couple the lower jaw to the eyes so as to be capable of producing a transitory eye movement responsive to movement of the lower jaw 18. The first portion 24 of mechanical linkage means 22 comprises a substantially rigid actuating member 48, which is most clearly visible in FIG. 4 to 6. Actuating member 48 is provided with engaging means 50 comprising a T-bar 52 at a free end thereof remote from the pivotal connection to the lower jaw on axis 26. The mechanical linkage means 22 further comprises first and second pivotal levers 54, each lever being adapted to engage the heel 38 of the projecting leg on the back of a respective eye 14 during pivotal movement of the lever 54 from a first rest position to a second activated position. In both FIGS. 4 and 5 the pivotal levers 54 are shown in the first position towards which they are biased by a small coil spring 56.

The hollow tubes 34 of the secondary tilt mechanism 28 for eyes 14 are attached to either end of a substantially rigid flat, elongate support plate 58, which may be made, for example, of transparent perspex material. The pivotal levers 54 are also pivotally mounted on support weight 58 and are biased by the coil springs 56 which are connected to projecting pins provided on the support plate 58. The first portion 24 of mechanical linkage means 22 is also biased by a small coil spring 60 which is connected to a pivot pin of lower jaw 18 on the first axis 20. Hence, the action of spring 60 tends to force the T-bar 52 on actuating member 48 against the support plate 58. Spring 60 also keeps the lower jaw 18 in a normally closed position. T-bar 52 engages with the pivotal levers 54 during an upward stroke of the actuating member 48 which occurs when the lower jaw is moved to open the mouth 16 of the teddy bear.

As T-bar 52 moves upward during an upward stroke of actuating member 48 the pivotal levers 54 will pivot downwards to engage the respective heels 38 on projecting legs 30 of eyes 14 causing the eyes to pivot towards an open position. However, as the T-bar 52 continues to move upwards, at a certain point the ends 62 of the levers 54 will disengage from the T-bar 52 and the springs 56 will cause the levers 54 to return to their first position. Depending on the current position of the eyes 14, the levers 54 may again engage the heel 38 of the projections 30 during their return stroke causing the eyes 14 to momentarily flick to a closed position, simulating a blinking of the eyes by the teddy bear. During a downwards stroke of actuating member 48 the T-bar 52 is adapted to ride over the ends 62 of levers 54 and therefore does not engage the pivotal levers during a downwards stroke. The T-bar 52 is rounded on its lower surface, and ends 62 of levers 54 are likewise rounded on their upper surfaces to enable the T-bar 52 to readily slide over the ends 62 of the levers 54 during a downwards stroke.

The mechanical linkage means 22 of the illustrated embodiment thus transitorily couples the lower jaw to the eyes so as to be capable of producing transitory eye movement responsive to movement of the lower jaw. However, the responsive eye movement is not easily predictable by a child as it depends upon the extent to which the lower jaw is moved towards the fully opened position as well as the current position of the eyes 14, which is in turn dependent on the orientation of the teddy bear's head. Thus, for example, if the teddy bear is held in a semi-recumbent position, by cradling in one arm in a typical feeding position, the eyes will be partly closed due to the action of gravity acting on the lead weights 40, as shown in FIG. 2 (*b*) or (*c*). The heel 38 of the projection 30 of both eyes 14 will therefore protrude through the slots 42 of hollow tubes 34. Hence, if a spoon with food on it is inserted into the teddy bear's mouth by forcing the lower jaw toward a fully opened position the action of mechanical linkage means 22 as described above will initially cause the eyes 14 to move to the fully opened position. Then, as the pivotal levers 54 are forced even further down by actuating member 48 they will ride over the heels 38 of the projections 30 and the eyes will pivot back to the semi-opened position. Finally, when the ends 62 of levers 54 escape from T-bar 52 the action of the return springs 56 causes the levers 54 to flick upwards again, momentarily engaging the heels 38 on projections 30 and causing the eyes 14 to momentarily shut in a blinking action.

For the child, it is as if the teddy bear is responding favourably by waking up to be fed. On the other hand, if the doll's mouth is only half opened the levers 54 may not engage heels 38, or may only push them down slightly, causing the eyes to open slightly further, providing only a slight response. If the doll is bottle fed by inserting the teat of a bottle through an aperture 64 provided for this purpose between the lips of the mouth 16, the teddy bear's eyes remain stationary corresponding to a typically contented facial expression. When the teddy bear is in a fully recumbent position, even moving the jaw to the fully opened position will not produce any responsive eye movement because levers 54 can no longer engage the heels 38 of projections 30 on the eyes 14, since heels 38 no longer protrude through slots 42 once the secondary tilt mechanism has come into play (see FIG. 3). It can be seen therefore that the mechanical linkage means 22 of this embodiment provides many variations in the responsive eye movement of the teddy bear which helps to increase the child's emotional involvement and enjoyment during play.

Figure 5:
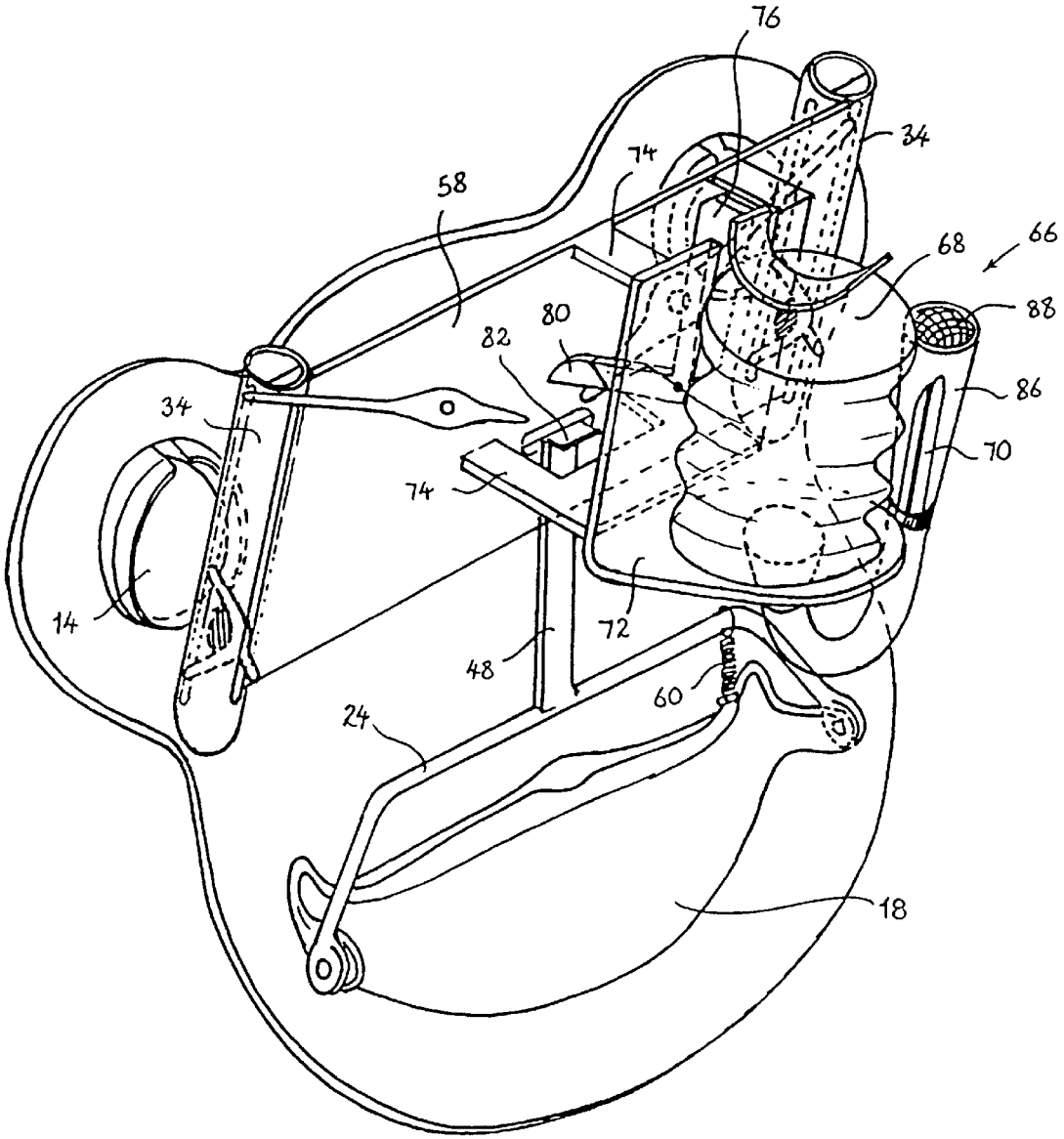
FIG. 5 is similar to FIG. 4 and also shows the location of a sound generating means.
Figure 6:
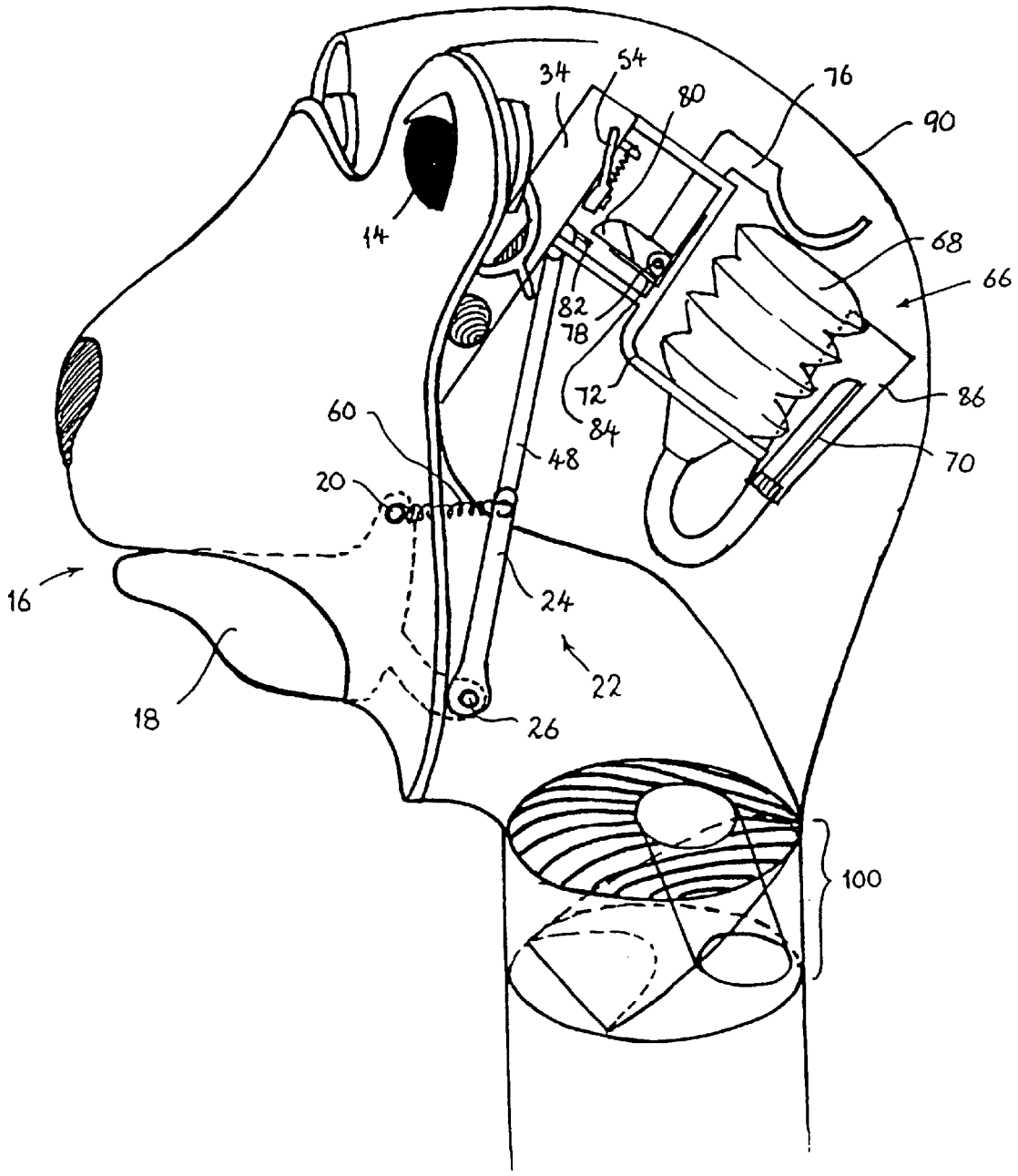
FIG. 6 is a side perspective view showing the position of the sound generating means.
Figure 7:
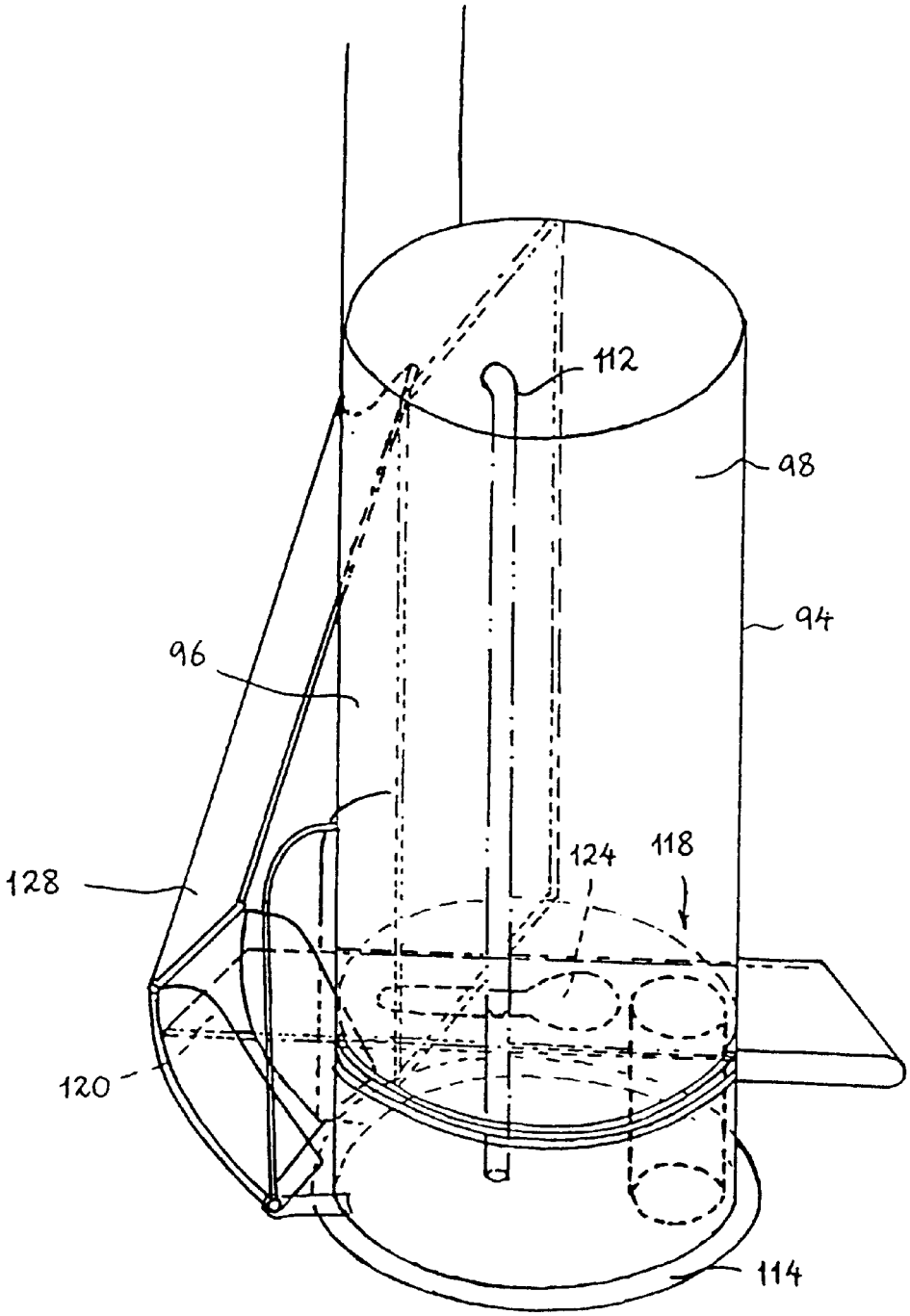
FIG. 7 is a top perspective view of an arrangement provided within the torso of the teddy bear of FIG. 1 for ingesting liquid and solid substances.

The enjoyment of a child may be further enhanced by the addition of a sound generating means 66 as illustrated in FIGS. 5 and 6 of the accompanying drawings. In this embodiment, sound generating means 66 comprises a mechanically operated bellows 68 and an air-driven vibratory reed 70, however it will be understood that any other appropriate sound generating means of the type that are commonly available for dolls can be employed. Bellows 68 is made of resilient air-tight material and is mounted within the head 12 of the teddy bear 10 on a bracket 72 which is fixed to support plate 58 by connecting members 74. The sound generating means 66 is activated by a pivotal member 76 which pivots at pivot point 78 on bracket 72, as can be seen most clearly in FIG. 6.

At one end pivotal member 76 engages the top of bellows 68 and is adapted to compress bellows 68 when pivotal member 76 pivots in a clockwise direction as viewed in FIG. 6. At its other end pivotal member 76 is provided with a one-way latch 80 which is adapted to engage with a protrusion 82 that forms part of engaging means 50 provided on the end of actuating member 48. When lower jaw 18 is moved towards an opened position, actuating member 48 commences its upwards stroke and protrusion 82 will eventually engage with latch 80 causing pivotal member 76 to pivot and compress the bellows 68 of the sound generating means 66. This forces air out of the bellows 68 to escape through vibratory reed 70. However, vibratory reed 70 is arranged to only produce a growling sound when air is drawn back into bellows 68 through the reed. Thus at this stage the teddy bear has made no sound. If at this point the lower jaw 18 is allowed to return to the closed position, actuating member 48 commences its downwards stroke and pivotal member 76 returns to its original position as shown in FIG. 6, due to the resilient nature of bellows 68. Simultaneously, air is drawn back into bellows 68 through reed 70 producing a short low growling sound.

If, on the other hand, lower jaw 18 is moved to a fully opened position it will cause the actuating member 48 to move the full extent of its upwards stroke. This will produce a responsive eye movement as described above, and it will also result in pivotal member 76 compressing bellows 68 to the fullest extent. At a certain point, latch 80 will disengage from protrusion 82 and bellows 68 will rapidly return to its expanded condition producing a loud and protracted growling sound from reed 70. As actuating member 48 commences its downwards stroke protrusion 82 will again engage with one-way latch 80, however one-way latch 80 is adapted to pivot freely in this direction thus enabling the actuating member 48 to complete its downwards stroke unhindered. One-way latch 80 is typically of tongue-and-groove configuration and is provided with a return leaf spring 84 which returns latch 80 to its normal position as shown in FIGS. 5 and 6.

It will be apparent that with this arrangement of sound generating means 66 there will also be considerable variation in the sound produced by the teddy bear responsive to movement of the lower jaw. This further enhances the play value of the doll. Vibratory reed 70 is provided with a small horn enclosure 86 and a dust cover 88 to prevent the reed 70 from becoming fouled due to dust and other contaminants. Sound generating means 66 and all of the other mechanisms provided behind the face of the teddy bear are enclosed within a protective casing 90 made of substantially rigid plastics material.

The play value of the teddy bear may be still further enhanced by incorporating the simulated physiological functions of ingestion of solid and liquid substances, as well as bowel movements and urination. A preferred arrangement for simulating these physiological functions will now be described with reference to FIGS. 7 to 10 and 1. As can be seen most clearly in FIG. 1, the torso 92 of the teddy bear is provided with a substantially cylindrical container 94 having first and second chambers 96, 98 provided therein. The first chamber 96 is adapted to contain liquid substances, and the second chamber 98 is adapted to contain solid substances. A separating means 100 is provided in a throat region of the teddy bear 10 for substantially separating liquid and solid substances inserted through the mouth 16 of the teddy bear 10. Appropriate edible liquid and solid food substances may be purchased as consumables for the teddy bear 10.

Separating means 100 is designed to substantially separate the liquid and solid substances whereby liquid and solid substances inserted through the mouth 16 are substantially separated before passing into the first and second chambers 96, 98 respectively. In this embodiment, separating means 100 comprises a circular sieve member 102 which extends over substantially the whole of the throat region with the exception of an aperture 104 (also illustrated in FIG. 6). The upper surface of sieve member 102 is of convex shape (see FIGS. 8 and 9) so that liquid falling thereon tends to flow away from aperture 104. Liquid passing through the sieve member 102 flows down an oblique plate member 106 and through a slot 108 into the first chamber 96. Aperture 104 is connected to the second chamber 98 by a connecting pipe 110 so that solid substances can pass through aperture 104 directly into the second chamber 98. A small quantity of liquid may also enter second chamber 98 through aperture 104, however the majority of liquid substances will flow through the sieve member 102 into the first chamber 96. The first chamber 96 is provided with an outlet tube 112 which extends from an upper region of the first chamber 96, (when in an upright position), to a lower region of the torso 92 of the teddy bear, typically a base 114 of container 94 on which the bear can be seated.

Figure 8:
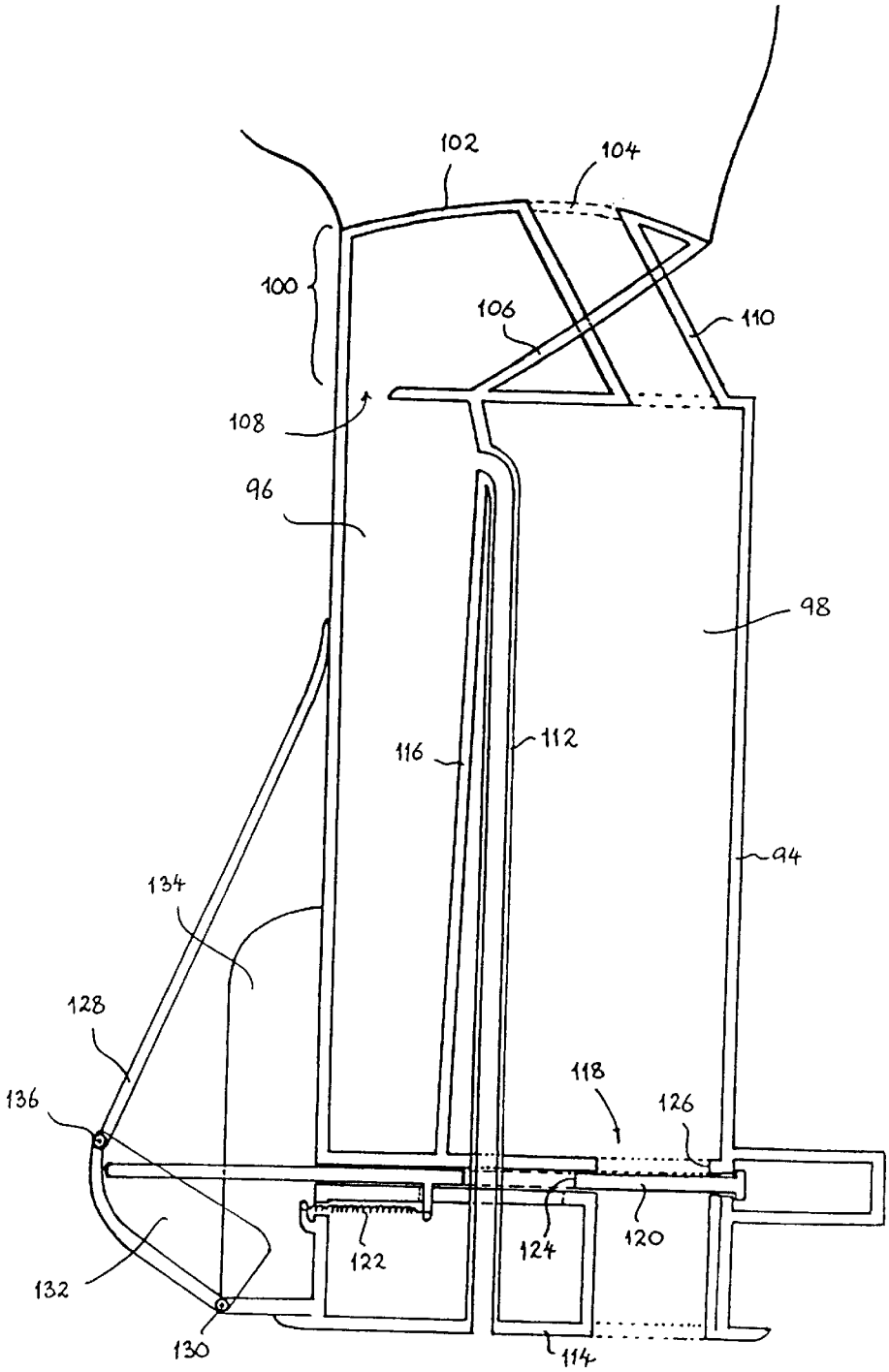
FIGS. 8 and 9 are both section views through the arrangement of FIG. 7 showing an outlet valve in a closed and opened position respectively; and, FIG. 10 illustrates the teddy bear of FIG. 1 seated on a potty with the outlet valve of FIGS. 8 and 9 in the opened position.
Figure 9:
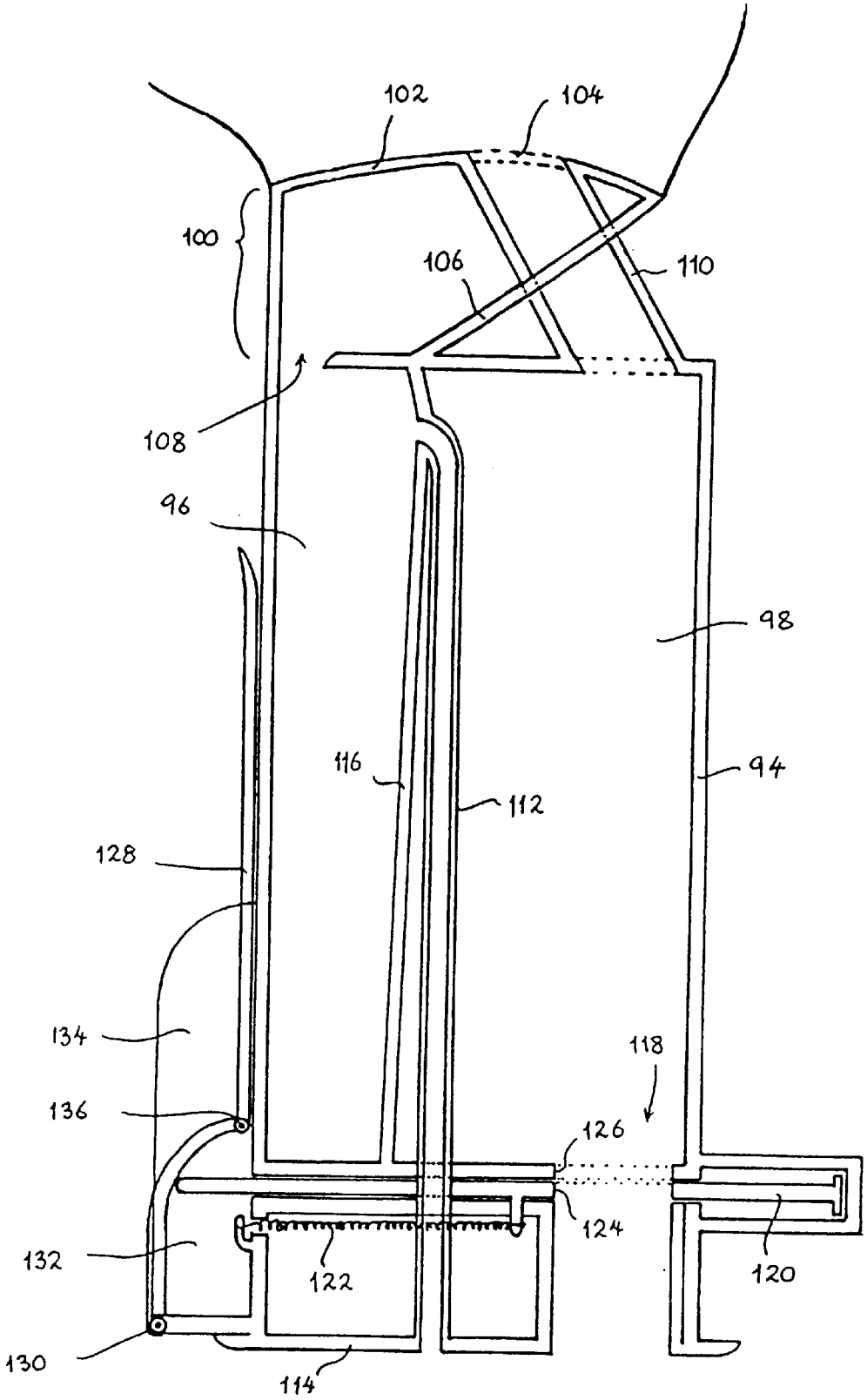

As can be seen most clearly in FIGS. 8 and 9, an inner wall 116 of the first chamber 96 has a slight gradient so that when the teddy bear is moved to a recumbent position, liquid substances contained within the first chamber 96 will flow down the inner wall 116 and drain out through the outlet tube 112.

The second chamber 98 is provided with an outlet valve 118 proximate a lower region of the torso 92 of the teddy bear. In this embodiment, the outlet valve 118 is in the form of a slide valve having a slidable closure member 120 which is biased by a coil spring 122 towards a normally closed position as illustrated in FIG. 8. Closure member 120 protrudes at the front of the torso 92 when the outlet valve 118 is in the closed position, and the outlet valve 118 can be opened by squeezing the torso adjacent the lower region, causing closure member 120 to slide inwards against the action of spring 122 as shown in FIG. 9. Closure member 120 is provided with a first aperture 124 which is brought into alignment with a second aperture 126 provided in a base of the second chamber 98 by pushing the slidable closure member 120 inwards. In this way, the contents of the second chamber 98 can be evacuated simulating a bowel movement. The first aperture 124 is elongated in one direction, as can be seen most clearly in FIG. 7, to accommodate tube 112 during sliding movement of closure member 120.

In order to facilitate a smooth sliding movement of closure member 120 and to prevent the closure member 120 from protruding from the belly of the teddy bear in an unsightly manner, a pivotal shield member 128 is provided at the front of container 94. Shield member 128 is pivotally connected to the base 114 of container 94 at pivotal connection 130 and is provided with side wings 132 designed to prevent stuffing (wool) used to fill the teddy bear 10 from interfering with the pivotal movement of shield member 128. Side wings 134 provided on the front of container 94 perform a similar function. Shield member 128 is articulated at pivot point 136 and the upper free end of shield member 128 is free to slide on the outer surface of container 94. Shield member 128 is kept firmly in place by the outer material and internal stuffing of the teddy bear 10.

Figure 10:
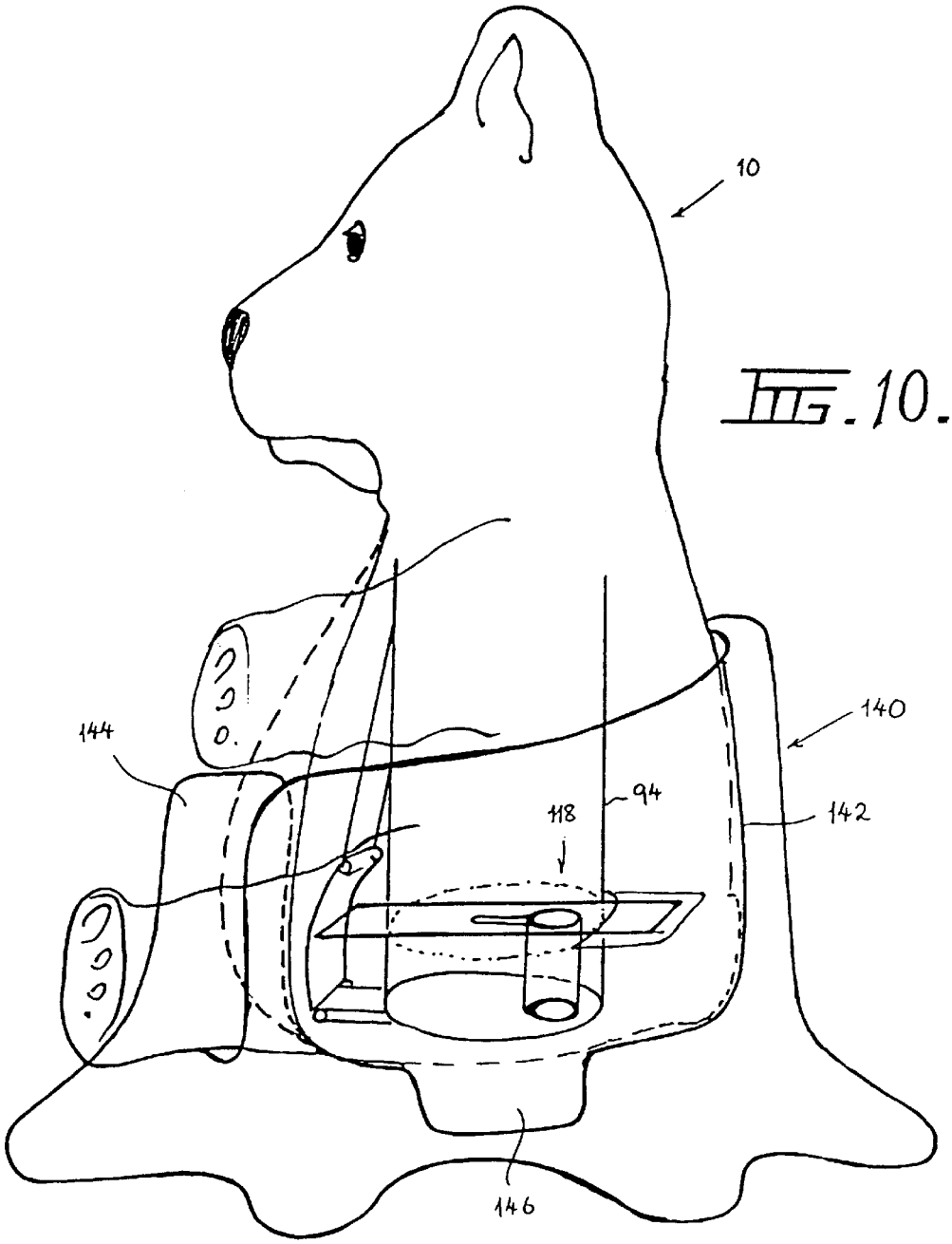

Advantageously, the teddy bear 10 is provided with its own chamber pot or potty 140 as illustrated in FIG. 10. Potty 140 is moulded in the shape of a tree stump in tune with the idea that teddy bears live in the woods. As illustrated in FIG. 10, potty 140 is provided with a recessed section 142 adapted to receive the teddy bear therein in a seated position. The potty 140 also has a protruding portion 144 which passes between the teddy bear's legs when seated on the potty, and which is adapted to press on the front of the teddy bear's torso in the lower region as the teddy bear 10 is pushed down into the recessed section 142 of the potty. As can be seen in FIG. 10, the protruding portion 144 forces the shield member 128 to pivot inwards, pushing closure member 120 of the outlet valve 118 inwards to the open position of the outlet valve as illustrated in FIG. 9. Thus, as the teddy bear 10 is seated on the potty 140 the second chamber 98 will automatically be evacuated, simulating a bowel movement on the potty 140. A recessed portion 146 in the bottom of the potty 140 receives any solid substances that may be evacuated through the outlet valve 118.

Figure 1:
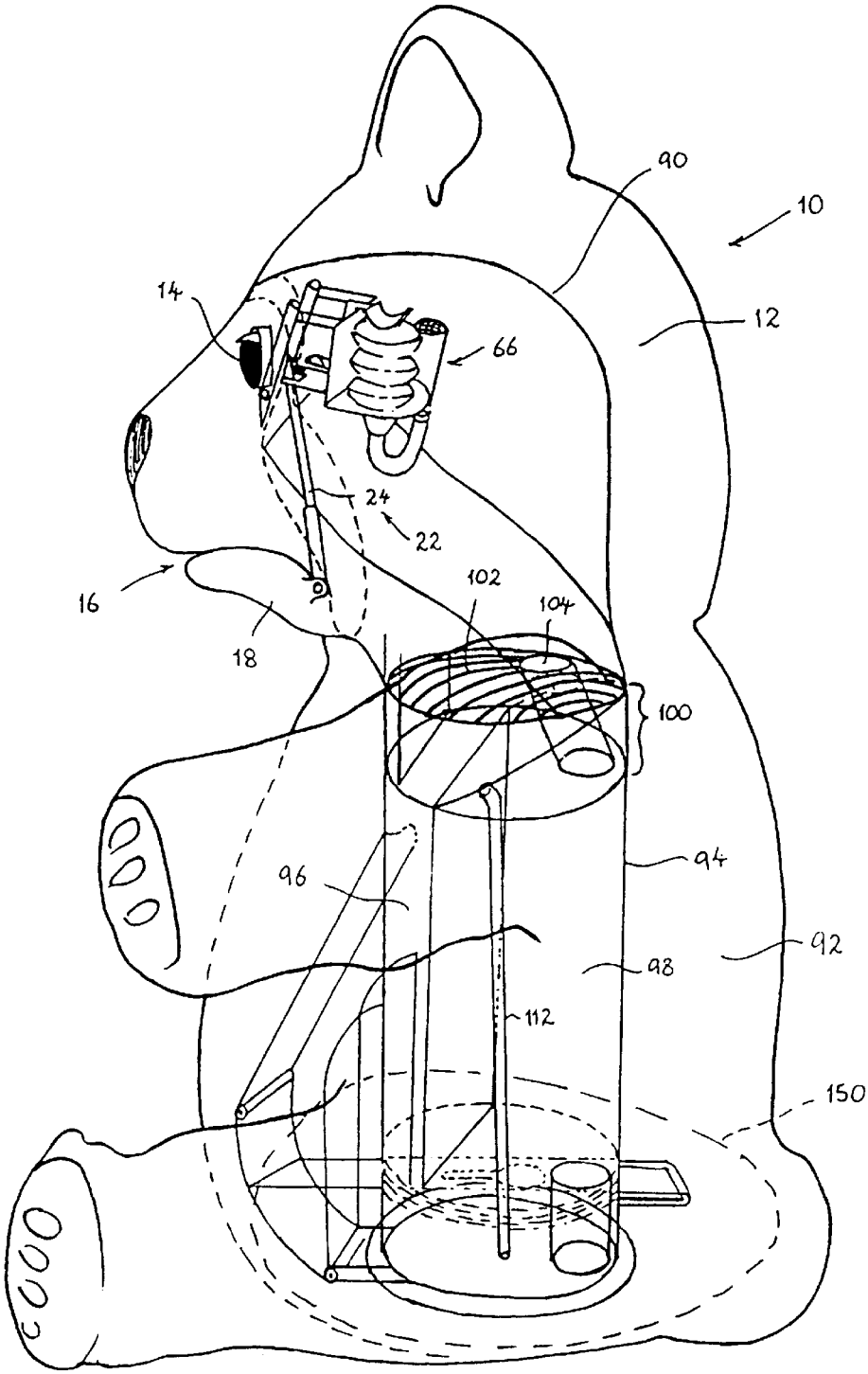
FIG. 1 illustrates a preferred embodiment of the doll according to the invention in the form of a toy teddy bear.

Virtually all of the internal components and mechanisms used to simulate physiological functions of the teddy bear described above are manufactured from injected moulded plastics materials. With the exception of the base, the outer surface of the teddy bear will be of soft synthetic fur material of known construction. The base 150 of the teddy bear 10, shown in broken outline in FIG. 1, is typically manufactured of vinyl plastics material for hygienic reasons. The base 114 of the container 94 within the torso 92 of the teddy bear can be glued to the inside surface of the vinyl base 150, which has cut into it appropriately sized openings for the outlet tube 112 and outlet valve 118 of the first and second chambers 96, 98 respectively. The vinyl base 150 can easily be wiped clean with a damp cloth to maintain the cleanliness of the teddy bear.

Now that a preferred embodiment of the doll with simulated physiological functions has been described in detail, it will be apparent that the described doll has a number of significant advantageous features. Included within these advantageous features is the fact that the physiological functions are simulated by all mechanical parts so that no batteries are required. Furthermore, as noted above, the ingenious arrangement of the internal mechanisms which simulate physiological functions, provides for a great variety of degrees of responsiveness, both visual and aural, which heighten the child's enjoyment and emotional attachment to the doll.

It will also be apparent that numerous variations and modifications may be made to the described embodiment of the doll, in addition to those already described, without departing from the basic inventive concepts. For example, mechanical linkage means 22 may be replaced with a single actuating lever with an extended T-bar for engaging the projections on the rear of the eyes 14 and on the sound generating means 66. The described arrangement is preferred because it provides a greater variety of responsive eye movement, including a simulated blinking action. Clearly, the outward appearance of the doll may take any form and is not restricted to a teddy bear. The internal mechanisms of the doll which provide the simulated physiological functions can be modified to fit within the head and torso of most dolls, including a human baby doll. All such variations and modifications are to be considered within the scope of the present invention, the nature of which is to be determined from the foregoing description and the appended claims.

We claim:

1. A doll with simulated physiological functions, including a head with eyes that can move, the doll further comprising:

a mouth that opens and closes, the head having a lower jaw that pivots about a first axis to provide the opening and closing action of the mouth;

mechanical linkage means having a first portion pivotally connected to said lower jaw and adapted to pivot about a second axis which is spaced from said first axis, said mechanical linkage means being adapted to transmit a movement of the lower jaw to another part of the doll, wherein said first portion of the mechanical linkage means comprises a substantially rigid actuating member having engaging means provided at a free end thereof remote from the pivotal connection to the lower jaw, and wherein said actuating member actuates a sound generating means whereby, in use, the sound generated is to some degree dependent on the extent of movement of the lower jaw; and wherein said sound generating means comprises a mechanically operated bellows and an air-driven vibratory reed, said bellows being activated by a pivotal member which engages a top of the bellows and is adapted to compress the bellows when pivoted from a rest position to an activated position, said engaging means being adapted to engage the pivotal member and move it from the rest position to the activated position whereby, in use, opening and/or closing of the mouth, for example to feed the doll, can produce a simulated physiological response from the doll.

2. A doll as defined in claim 1, wherein said pivotal member is provided with a one-way latch and said engaging means is provided with a protrusion adapted to engage said one-way latch wherein, in use, when said protrusion engages said one-way latch during an upwards stroke of said actuating member movement is transmitted to said pivotal member, but when said protrusion engages said one-way latch during a downwards stroke said one-way latch pivots freely and no movement is transmitted to said pivotal member.

3. A doll as defined in claim 2, wherein the doll's eyes are designed to pivot from an opened towards a closed position and vice versa, and wherein each eye is provided with a secondary tilt mechanism to cause the eye to pivot to a fully closed position when the doll is lying down.

4. A doll as defined in claim 3, wherein said secondary tilt mechanism comprises a projection provided at the back of each eye, and a moveable weight with a guide on which the moveable weight can move, said guide being mounted relative to the eye such that when the doll is lying down it is tilted at a sufficient angle to enable the moveable weight to move down the guide under the force of gravity whereby, in use, the moveable weight can engage said projection to cause the eye to pivot to the fully closed position.

5. A doll as defined in claim 4, wherein said mechanical linkage means further comprises a pair of pivotal levers, each lever being adapted to engage said projection on a respective eye during pivotal movement from a first position to a second position, and wherein said engaging means of the actuating member engages said pivotal levers to effect said pivotal movement when the lower jaw is moved to open the mouth.

6. A doll as defined in claim 5, wherein said engaging means engages said pivotal levers to effect said pivotal movement during an upward stroke of the actuating member which occurs when the lower jaw is moved to open the mouth, and wherein both pivotal levers are biased to produce a return movement to said first position when said engaging means disengages the pivotal levers, each pivotal lever being adapted to momentarily engage said projection on a respective eye during said return movement.

7. A doll with simulated physiological functions, the doll compromising:

a head with a mouth through which liquid and solid substances can be inserted;

a torso having first and second chambers provided therein and adapted to contain said liquid and solid substances respectively; and, a separating means provided in a throat region of the doll for substantially separating said liquid and solid substances, wherein said separating means comprises a sieve member extending over substantially the whole of said throat region with the exception of an aperture, said sieve member being adapted to pass said liquid substance therethrough but to prevent said solid substances from passing therethrough other than through said aperture, and wherein said aperture is connected to said second chamber whereby, in use, said solid substances can pass through said aperture directly into the second chamber.

8. A doll as defined in claim 7, wherein said second chamber is provided with an outlet valve proximate a lower region of the torso and which is biased towards a normally closed position, and wherein the outlet valve can be opened by squeezing the torso adjacent said lower region.

9. A doll as defined in claim 8, wherein said outlet valve is in the form of a slide valve having a slidable closure member which protrudes at the front of the torso when the outlet valve is in the closed position.

10. A doll as defined in claim 9, wherein the slidable closure member has a first aperture provided therein which can be brought into alignment with a second aperture provided in a base of the second chamber by pushing the slidable closure member inwards whereby, in use, the contents of the second chamber can be evacuated.

11. A doll as defined in claim 8, further provided with a chamber pot or "potty" on which the doll can be seated for toileting, the potty having a protruding portion which passes between the doll's legs when seated on the potty and which is adapted to press on the doll's torso adjacent said lower region whereby, in use, said outlet valve can be actuated to evacuate the contents of the second chamber into the potty.

* * * * *